US010731284B2

(12) United States Patent
Alexander et al.

(10) Patent No.: US 10,731,284 B2
(45) Date of Patent: Aug. 4, 2020

(54) CLOTHES WASHER WITH A CLOTHES MOVER HAVING A REMOVABLE CAP

(71) Applicant: WHIRLPOOL CORPORATION, Benton Harbor, MI (US)

(72) Inventors: Benjamin E. Alexander, Stevensville, MI (US); Scott E. Carpenter, Wanatah, IN (US); Mark A. Davis, Grand Rapids, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 242 days.

(21) Appl. No.: 15/370,629

(22) Filed: Dec. 6, 2016

(65) Prior Publication Data

US 2018/0155864 A1 Jun. 7, 2018

(51) Int. Cl.

| | |
|---|---|
| ***D06F 39/02*** | (2006.01) |
| *D06F 23/04* | (2006.01) |
| *D06F 13/02* | (2006.01) |

(52) U.S. Cl.

CPC ..... *D06F 39/024* (2013.01); *D06F 39/022* (2013.01); *D06F 13/02* (2013.01); *D06F 23/04* (2013.01)

(58) Field of Classification Search

CPC ..... D06F 39/024

See application file for complete search history.

(56) References Cited

U.S. PATENT DOCUMENTS

| | | | | |
|---|---|---|---|---|
| 4,154,069 | A | 5/1979 | Lipfert et al. | |
| 4,240,277 | A * | 12/1980 | Manthei | D06F 39/024 68/17 A |
| 5,359,744 | A | 11/1994 | Kimball et al. | |
| 5,500,967 | A * | 3/1996 | Wilson | D06F 39/024 68/17 A |
| 6,301,734 | B1 | 10/2001 | Dunsbergen et al. | |
| 2003/0182732 | A1* | 10/2003 | Davenet | A47L 15/4454 8/158 |
| 2004/0016267 | A1* | 1/2004 | Clark | D06F 13/02 68/133 |
| 2006/0144099 | A1* | 7/2006 | Aouad | D06F 39/024 68/196 |
| 2012/0151971 | A1 | 6/2012 | Di Bono et al. | |

* cited by examiner

*Primary Examiner* — Joseph L. Perrin
*Assistant Examiner* — Irina Graf
(74) *Attorney, Agent, or Firm* — McGarry Bair PC

(57) ABSTRACT

A laundry treating appliance having a cabinet, a wash tub located within the cabinet and defining an interior, a wash basket mounted within the wash tub and defining a laundry treating chamber. A clothes mover or agitator can be located within and rotatable relative to and/or with the wash basket having a cap removably mounted to the clothes mover. The cap includes a treating chemistry dispenser system.

20 Claims, 5 Drawing Sheets

CLOTHES WASHER WITH A CLOTHES MOVER HAVING A REMOVABLE CAP

BACKGROUND OF THE INVENTION

Laundry treating appliances, such as vertical axis clothes washers, typically include a cabinet, a tub in the interior of the cabinet, and a rotatable wash basket mounted in the tub that receives laundry for treatment according to a cycle of operation. A clothes mover or agitator can be located within and rotatable relative to and/or with the wash basket. The agitator can be oscillated or rotated about its axis of rotation during a cycle of operation in order to provide movement to the fabric load contained within the laundry treating chamber.

BRIEF DESCRIPTION

One aspect of the present disclosure relates to a clothes washer having a tub at least partially defining a liquid chamber, a basket rotatably mounted within the liquid chamber and defining a treating chamber, a clothes mover located within the treating chamber and rotatable about a vertical axis and a cap removably mounted to the clothes mover. The cap includes a first treating chemistry reservoir defined by the cap, an outlet, and a manually-actuable valve selectively coupling the first treating chemistry to the outlet and having an actuator located on the exterior of the cap.

Another aspect of the invention relates to an agitator assembly for a clothes washer having a base, a barrel terminating in a top, and a cap removably mounted to the top. The cap includes a first treating chemistry reservoir defined by the cap, an outlet, and a manually-actuable valve selectively coupling the first treating chemistry to the outlet and having an actuator located on the exterior of the cap.

DETAILED DESCRIPTION

The present disclosure sets forth a washing machine with a clothes mover having a cap with an integrated dispenser that is easily accessible to the user. The user can operate the dispenser to dispense treating chemistry directly and visibly onto a laundry load in the washing machine. This enables the user to receive instant visual feedback to the dispensing process and the remaining treating chemistry available within the reservoir.

By way of summary, the systems and components set forth in this disclosure enable a user, prior to initiation of a treatment cycle, to determine the amount of the treating chemistry to be used for the washing cycle. By pressing a valve actuator button on the cap, the user can visibly dispense treating chemistry onto the laundry load. The visible passing of the treating chemistry onto the laundry load provides confirmation to the user that the treating chemistry was dispensed and lets the user approximate by visual inspection the amount of treating chemistry that is dispensed. Moreover, the elevated and central location of the cap within the wash chamber provides a convenient location for the user to access.

Figure 1:
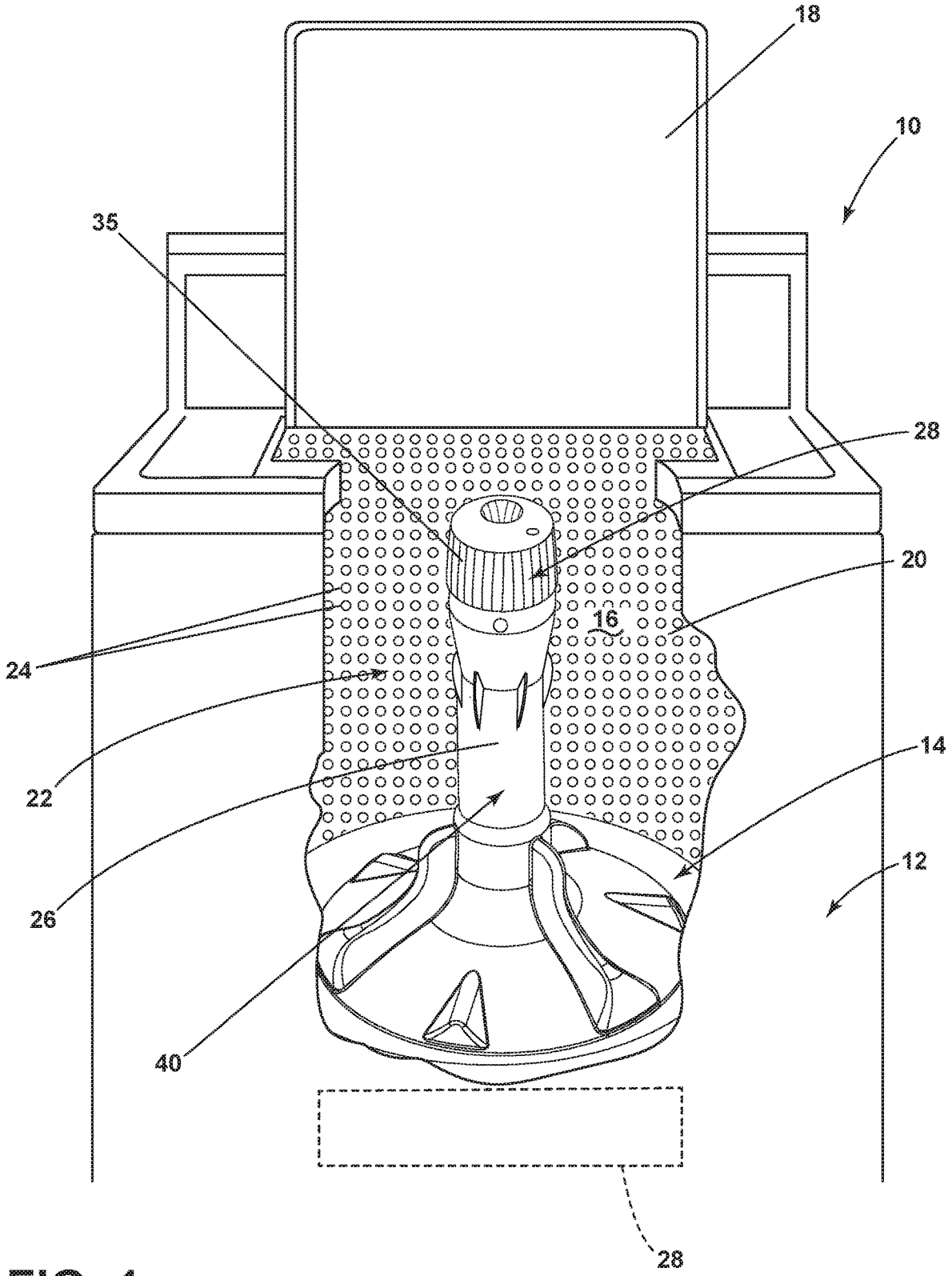
FIG. 1 is a front view of a vertical clothes washer with an exemplary agitator assembly.

In more detail, FIG. 1 illustrates an exemplary laundry treating appliance in the form of a clothes washer 10 according to a first embodiment in accordance with the present disclosure. While the laundry treating appliance has been illustrated as a vertical axis, top-loading washing machine, embodiments in accordance with the present disclosure may have applicability in other laundry treating appliances including by way of non-limiting example a combination laundry washing and drying machine, a non-aqueous laundry treating appliance, etc.

The clothes washer 10 includes a cabinet or housing 12 and a tub 14 that defines an interior 16 of the clothes washer 10. The tub 14 is configured to hold liquids during the washing process. A drum or basket 20 is located within the interior 16 of the tub 14 and is rotatable relative to the tub 14. The basket 20 defines a laundry treating chamber 22 for receiving a laundry load for treatment according to an automatic cycle of operation. The top of the cabinet 12 can include a selectively openable lid 18 to provide access into the laundry treating chamber 22 through an open top of the basket 20.

The basket 20 can include a plurality of perforations or apertures 24 such that liquid supplied to the basket 20 can flow through the perforations 24 to the tub 14. While the embodiments are described in the context of a clothes washer having a rotatable basket located within a tub, it will be understood that the embodiments can also be used in a clothes washer which has an imperforate basket without a tub.

A clothes mover in the form of an agitator 26 can be located within the laundry treating chamber 22 and rotatable relative to and/or with the basket 20. While the clothes mover is illustrated as an agitator, the clothes mover can also be an impeller, pulsator, auger, etc., which is rotated within the basket to effect movement of liquid in the basket or directly impact the laundry to apply mechanical energy indirectly or directly to the laundry. The basket 20 and/or the agitator 26 can be driven by an electrical motor 28, which may or may not include a gear case, operably connected to the basket 20 and/or the clothes mover 26. The agitator 26 can be commonly oscillated or rotated about its axis of rotation during a cycle of operation in order to provide movement to the load contained within the laundry treating chamber 22. The basket 20 alone or in combination with the agitator 26 can be rotated at high speed to centrifugally extract liquid from the load and to discharge the extracted liquid from the basket 20.

A dispensing system 28 can be provided to the clothes washer 10 for supplying treating chemistry to the treating chamber 22. The dispensing system 28 can include a detergent dispenser 51, which can be a single use dispenser, a bulk dispenser or a combination of a single use and bulk dispenser. The detergent dispenser 51 can be disposed at the top of the agitator 26 as part of an agitator assembly 40 for providing one or more treating chemistries to the treating chamber 22. The treating chemistries can be provided in the form of at least one of liquid, powder, pod, compressed puck, or combination thereof.

Though this exemplary embodiment includes a detergent dispenser 51, non-limiting examples of treating chemistries that can be dispensed by the dispensing system 28 in similar fashion during a cycle of operation include one or more of the following: water, surfactants, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

Figure 2:
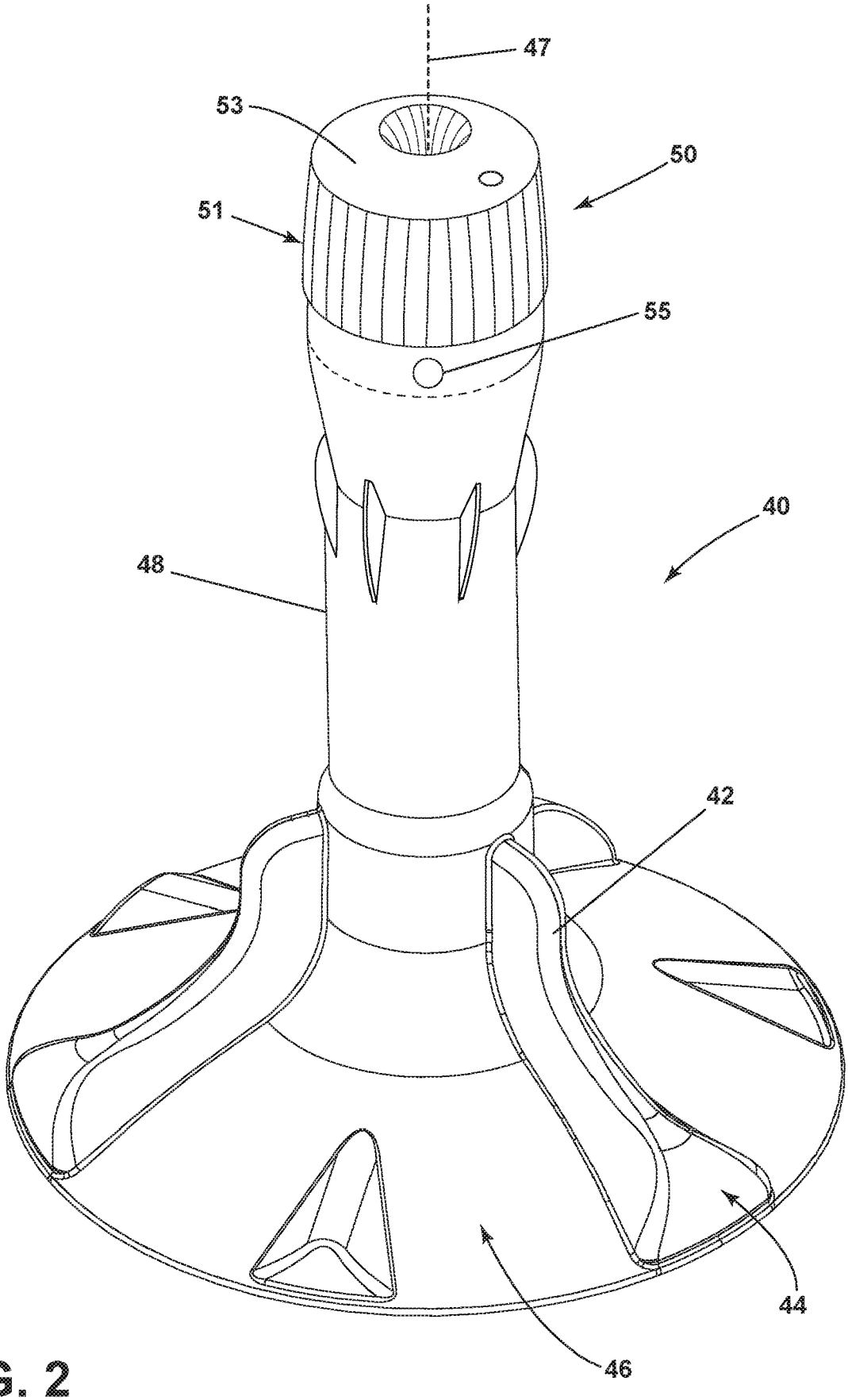
FIG. 2 is a perspective view of the agitator assembly of FIG. 1.

The agitator assembly 40 is illustrated in FIG. 2. The agitator assembly 40 includes a base 46 from which extends a barrel 48, which collectively rotate about rotational axis 47. A plurality of spaced, vertically-oriented vanes 42, for moving a load of clothes placed in the basket 20, are provided on the base 46 and flare outwardly at their lower extremities 44, with their lowermost edges transitioning to the base 46.

The agitator assembly 40 has a removable cap 50, which is releaseably (e.g., threaded, snapped, pressed, bayonet, etc.) mounted to the upper portion of barrel 48. The cap 50 can include a detergent dispenser 51 that in this example allows for bulk storage and dispensing. Detergent dispenser 51 has a first reservoir 53 defined by the cap 50. The cap 50 can be made of transparent material to allow the user to monitor the amount of treating chemistry remaining. The reservoir 53 can be refillable with treating chemistry or is a prefilled consumable product. A dispensing outlet 55 can be provided on the sidewall of the barrel 48.

Figure 3:
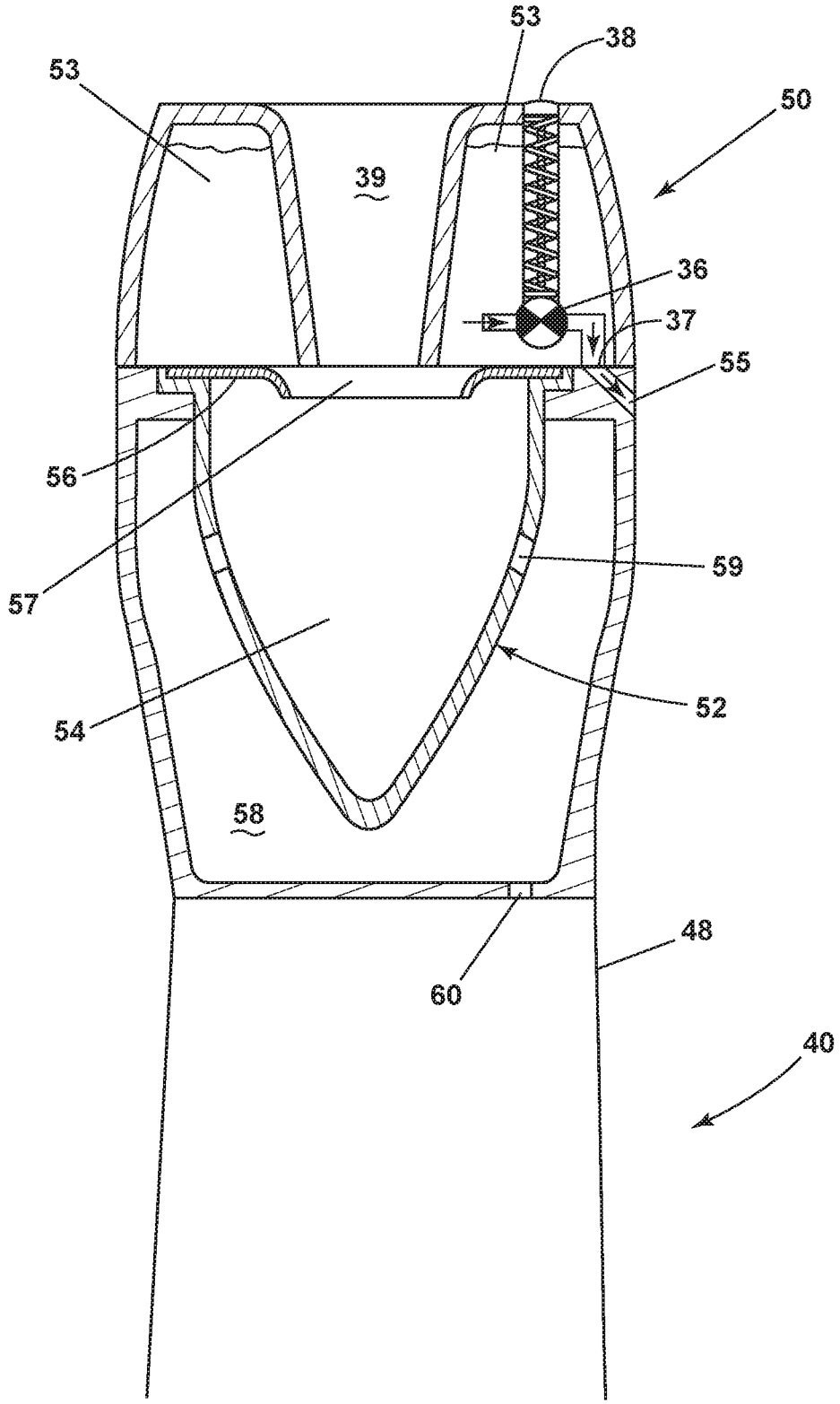
FIG. 3 is a schematic cross-sectional view of a portion of the agitator assembly of FIG. 1.

Referring to FIG. 3, removable cap 50 can sit atop a centrifugally actuated dispensing cup 52 located within the interior of the barrel 48. Any centrifugally actuated dispensing cup system can be used in accordance with the present disclosure. The dispensing cup 52 defines a second treating chemistry reservoir 54 having a cover member 56 with a fluid passage 57 to receive a dosage of treating chemistry. The dispensing cup 52 can be fluidly coupled to a treating chemistry chamber 58 through a plurality of circumferentially spaced openings 59, which lead to a dispensing passage 60 that leads out the base 46 of the agitator assembly 40. In this way, treating chemistry from the cup 52, which is typically fabric softener, can be centrifugally dispensed during a liquid extraction phase to the tub 14 through the interior of the agitator assembly, which prevents a direct deposit of the treating chemistry onto the laundry. Alternatively, the dispensing passage 60 could be located in the side wall of the barrel 48 and provide for dispensing into the basket 20, instead of the tub 14.

The cap 50 includes a valve 36 with an actuator button 38 that controls fluid flow through an outlet opening 37. The outlet opening 37 fluidly couples the treating chemistry reservoir 53 to the dispensing outlet 55 molded to the sidewall of the barrel 48. The treating chemistry can be released by selectively actuating the valve 36 to open/close the opening 37 to the dispensing outlet 55. The valve actuator button 38 is accessible from the exterior of the cap 50 and controls the selective opening/closing of the valve 36. The actuator button 38 can be configured such that depressing of the actuator button 38 dispenses a predetermined amount of treating chemistry regardless of how long the actuator button 38 is depressed or it can continuously dispense treating chemistry as long as it is depressed. The valve actuator button 38 can be disposed in any place on the exterior of the cap 51 so as to be accessible by the user.

The cap 50 can be provided with a liquid pass through opening 39 that is fluidly coupled to the fluid passage 57 of the centrifugally actuated dispensing cup 52 cover member 56. The pass-through opening 39 allows for the direct filling of the second treating chemistry reservoir 54 without the need to remove the cap 50.

Prior to initiation of a treatment cycle, a user can determine the amount of the treating chemistry to be used for the washing cycle. By pressing the valve actuator button 38 on the exterior of cap 50 to actuate the valve 36, the user can visibly dispense the treating chemistry from the first reservoir 53, through the opening 37 and dispensing outlet 55 on the barrel 48. The visible passing of the treating chemistry through the dispensing outlet 55 provides confirmation to the user that the treating chemistry was dispensed and lets the user approximate by visual inspection the amount of treating chemistry that is dispensed.

Emission of the treating chemistry can be continued for as long as the valve actuator button 38 is actuated or alternatively, each depression of the actuator button 38 can dispense a predetermined amount of treating chemistry, and the user can depress the actuator button 38 as many times as needed to get the desired amount of treating chemistry.

Figure 4:
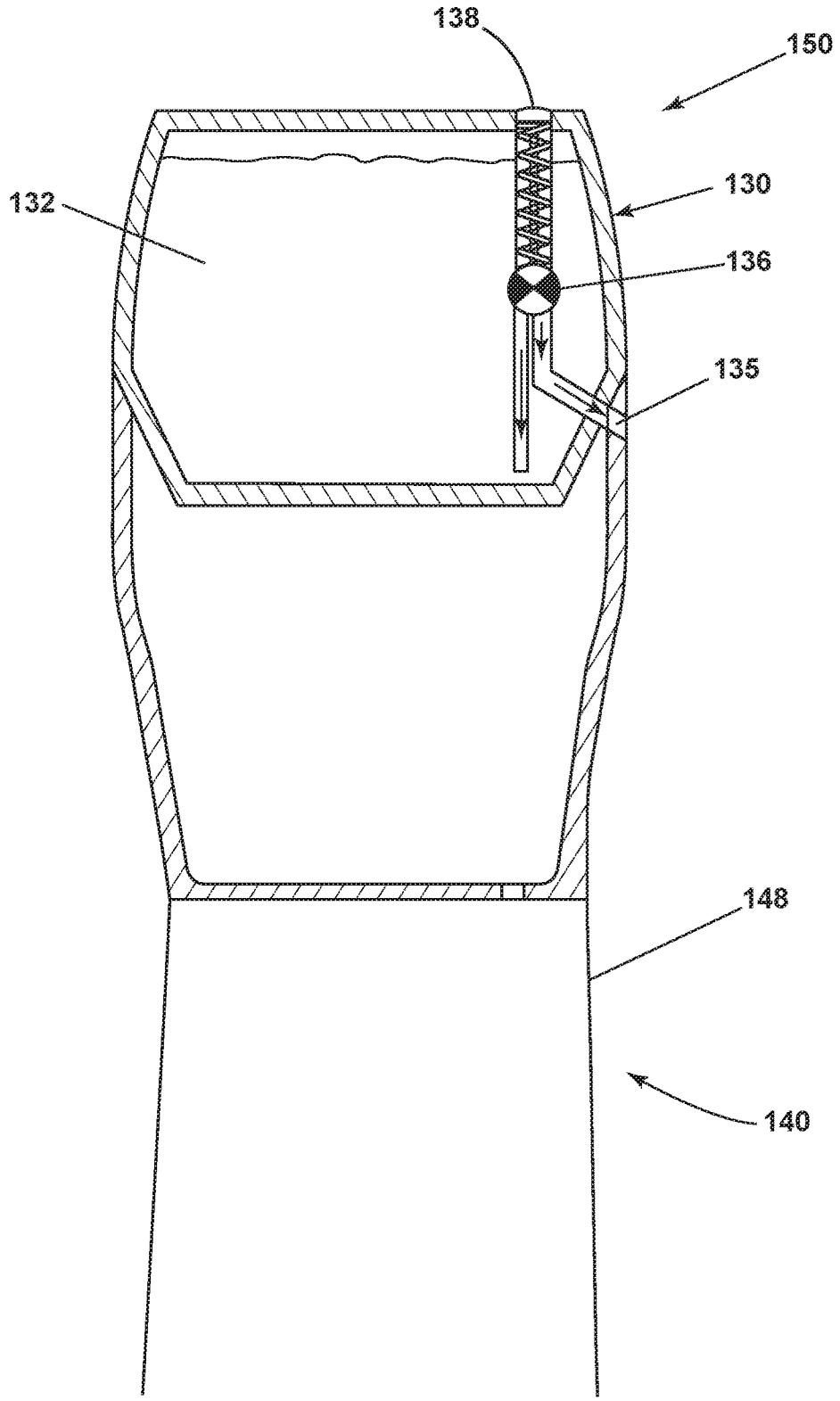
FIG. 4 is a schematic cross-sectional view of a second exemplary agitator assembly.

In a non-limiting example, the cap 50 can be used to dispense a detergent as the first treating chemistry for use in the wash phase of the cycle of operation, and a liquid fabric softener can be the second treating chemistry located in reservoir 54, which is centrifugally dispensed during an extraction phase following the wash phase. Another exemplary agitator assembly 140 is illustrated in FIG. 4 and is substantially similar to the agitator assembly of FIG. 3, with numerals being increased by a value of one hundred, and that the discussion will be limited to differences among the two. In FIG. 4, an agitator assembly 140 with similar structure to the first example includes a barrel 148 having a dispensing outlet 135 molded to the sidewall of the barrel 148, and a top mounted cap 150 with a detergent dispenser 130 fluidly coupled to the dispensing outlet 135. The agitator assembly 140 differs from that of FIGS. 1-3 in that the barrel 148 does not carry a centrifugally actuated dispensing cup. Instead, the cap 150 defines a treating chemistry reservoir 132 with a larger volume that partially extends into the space occupied by the centrifugally actuated dispensing cup 52 (FIG. 3) shown in the previous example. The cap 150 also differs in that there are no pass through openings 39 (FIG. 3) at the terminal end of the cap 150 which further increases the volume and capacity of the treating chemistry reservoir 132. The actuator button 138 can function as a pump for the valve 136 to pump the treating chemistry in the reservoir 132 below the valve 136.

Figure 5:
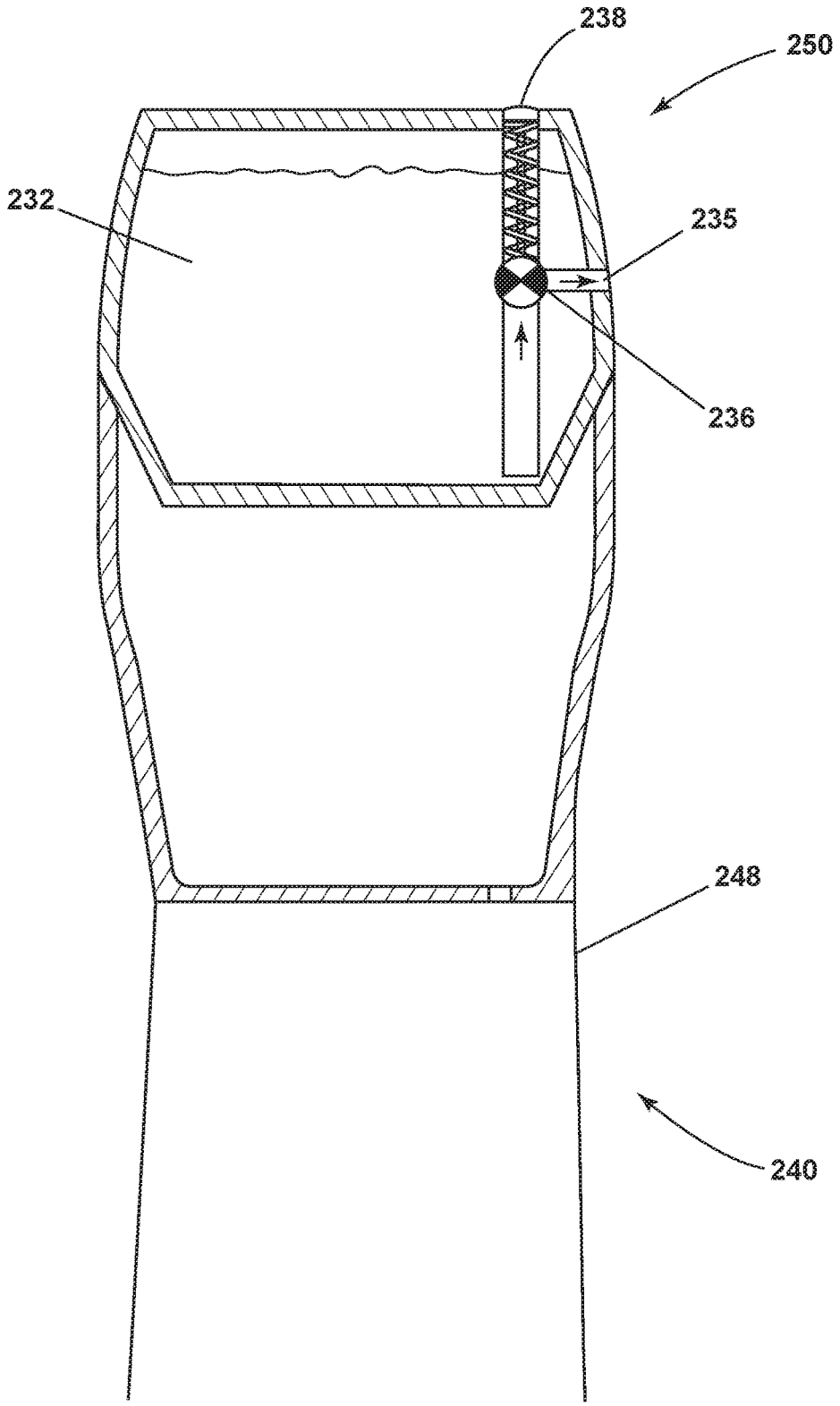
FIG. 5 is a schematic cross-sectional view of a third exemplary agitator assembly.

A third exemplary agitator assembly 240 is illustrated in FIG. 5. FIG. 5 can be substantially similar to that of FIG. 4, with numerals being increased by a value of two hundred, and that the discussion will be limited to differences among the two.

In FIG. 5, an agitator assembly 240 with similar structure to the second example includes a treating chemistry reservoir 232 defined by a cap 250 having a valve 236 and a valve actuator button 238. The agitator assembly 240 differs in that the barrel 248 is not provided with a dispensing outlet 135 (FIG. 4) that is fluidly coupled to the treating chemistry reservoir 232. Instead, the treating chemistry reservoir 232 includes a dispensing outlet 235 in the exterior of the cap 250.

The cap for all of the embodiments having an integrated dispenser is easily accessible to the user as it is integral to the agitator assembly located at the center point of the wash area. As the operation of the dispenser is managed by the user, the present invention provides instant visual feedback to the dispensing process and the remaining treating chemistry available within the reservoir. The aesthetic appearance of the dispenser that is integral to the agitator assembly will be a differentiating feature that is easily understood and contributes to the overall user satisfaction.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While the present disclosure has been set forth in connection with certain specific embodiments, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A clothes washer comprising:
- a tub at least partially defining a liquid chamber;
- a basket rotatably mounted within the liquid chamber and defining a treating chamber;
- a clothes mover defining an interior, having a dispensing outlet, located within the treating chamber, and rotatable about a vertical axis; and
- a cap removably mounted to the clothes mover and having:
  - a first treating chemistry reservoir defined by the cap;
  - an outlet opening fluidly coupled to the dispensing outlet;
  - a conduit bypassing the interior of the clothes mover and extending directly between the outlet opening and the dispensing outlet;
  - a manually-actuable valve configured to control a fluid flow of a first treating chemistry directly into the treating chamber via the conduit by selectively coupling the first treating chemistry reservoir to the outlet opening; and
  - an actuator configured to control the manually-actuable valve located on an exterior of the cap.

2. The clothes washer of claim 1 wherein the clothes mover comprises an agitator having a base with a barrel terminating in a top and the cap is mounted to the top.

3. The clothes washer of claim 2 wherein the cap is threadably mounted to the top.

4. The clothes washer of claim 2 wherein the barrel further comprises a second treating chemistry reservoir.

5. The clothes washer of claim 4 wherein the cap comprises a pass-through passage fluidly coupled to the second treating chemistry reservoir whereby the second treating chemistry reservoir is fillable through the pass-through passage.

6. The clothes washer of claim 5 wherein the second treating chemistry reservoir is fluidly coupled to the treating chamber by a dispensing passage.

7. The clothes washer of claim 6 wherein the second treating chemistry reservoir is a centrifugal dispenser.

8. The clothes washer of claim 5 wherein the first treating chemistry reservoir is sized to receive multiple doses of a first treating chemistry.

9. The clothes washer of claim 4 wherein the conduit bypasses the second treating chemistry reservoir.

10. The clothes washer of claim 2 wherein the outlet opening is fluidly coupled to a dispensing outlet in the barrel.

11. The clothes washer of claim 1 wherein the first treating chemistry reservoir is sized to receive multiple doses of the first treating chemistry.

12. A clothes washer comprising:
- a tub at least partially defining a liquid chamber;
- a basket rotatably mounted within the liquid chamber and defining a treating chamber;
- a clothes mover located within the treating chamber and rotatable about a vertical axis;
- a centrifugal dispenser located within the clothes mover;
- a cap removably mounted to the clothes mover and having:
  - a first treating chemistry reservoir defined by the cap;
  - an outlet opening;
  - a manually-actuable valve configured to control a flow of treating chemistry through the outlet opening by selectively coupling the first treating chemistry reservoir to the outlet opening;
  - a treating chemistry channel bypassing the centrifugal dispenser and extending from the manually-actuable valve to the treating chamber; and
  - an actuator configured to control the manually-actuable valve located on an exterior of the cap.

13. The clothes washer of claim 12 wherein the clothes mover comprises an agitator having a base with a barrel terminating in a top and the cap is mounted to the top.

14. The clothes washer of claim 13 wherein the cap is threadably mounted to the top.

15. The clothes washer of claim 13 wherein the treating chemistry channel is fluidly coupled to a dispensing outlet in the barrel.

16. The clothes washer of claim 13 wherein the centrifugal dispenser defines a second treating chemistry reservoir located in the barrel.

17. The clothes washer of claim 16 wherein the cap comprises a pass-through passage fluidly coupled to the centrifugal dispenser whereby the centrifugal dispenser is fillable through the pass-through passage.

18. The clothes washer of claim 17 wherein the centrifugal dispenser is fluidly coupled to the treating chamber by a dispensing passage.

19. The clothes washer of claim 12 wherein the outlet opening is fluidly coupled to the treating chamber wherein manual activation of the actuator releases the treating chemistry from the first treating chemistry reservoir directly into the treating chamber.

20. The clothes washer of claim 12 wherein the first treating chemistry reservoir is sized to receive multiple doses of the treating chemistry.

* * * * *